US011801966B2

(12) United States Patent
De Blay

(10) Patent No.: US 11,801,966 B2
(45) Date of Patent: Oct. 31, 2023

(54) CYLINDRICAL CARDBOARD CONTAINER

(71) Applicant: ABZAC France, Abzac (FR)

(72) Inventor: Aymeric De Blay, Abzac (FR)

(73) Assignee: ABZAC France

( * ) Notice: Subject to any disclaimer, the term of this patent is extended or adjusted under 35 U.S.C. 154(b) by 0 days.

(21) Appl. No.: 17/806,017

(22) Filed: Jun. 8, 2022

(65) Prior Publication Data

US 2023/0128493 A1 Apr. 27, 2023

Related U.S. Application Data

(60) Provisional application No. 63/270,675, filed on Oct. 22, 2021.

(51) Int. Cl.

| | |
|---|---|
| ***B65D 5/50*** | (2006.01) |
| ***B65D 43/26*** | (2006.01) |
| *B65D 81/05* | (2006.01) |

(52) U.S. Cl.

CPC ..... *B65D 5/503* (2013.01); *B65D 43/26* (2013.01); *B65D 81/05* (2013.01); *B65D 2543/00805* (2013.01); *B65D 2585/54* (2013.01)

(58) Field of Classification Search

CPC ..... B65D 5/503; B65D 43/26; B65D 81/05; B65D 2543/00805; B65D 2585/54; B65D 45/34; B65D 45/345; B65D 77/048; B65D 77/0486; B65D 77/049

USPC ..... 220/23.88, 495.01, 495.02, 495.03; 206/557, 561–565

See application file for complete search history.

(56) References Cited

U.S. PATENT DOCUMENTS

| | | | | |
|---|---|---|---|---|
| 711,024 A | | 10/1902 | Toy | |
| 1,960,279 A | * | 5/1934 | Read | B65D 5/503 217/26.5 |
| 2,812,856 A | | 11/1957 | Lantinberg | |
| 3,561,637 A | * | 2/1971 | McConnell | B65D 45/32 229/5.7 |

FOREIGN PATENT DOCUMENTS

| | | |
|---|---|---|
| DE | 8319841 U1 | 10/1983 |
| EP | 1160180 A1 | 12/2001 |
| KR | 200475107 Y1 | 11/2014 |

* cited by examiner

*Primary Examiner* — Andrew D Perreault

(74) *Attorney, Agent, or Firm* — Mintz, Levin, Cohn, Ferris, Glovsky and Popeo, P.C.

(57) ABSTRACT

A cylindrical cardboard container comprising: a circular bottom wall having an outer bottom wall edge; a cylindrical sidewall extending upwardly from the bottom wall edge, the circular bottom wall and the cylindrical sidewall delimiting a receiving cavity sized and shaped to receive a plurality of items; a plurality of item holders for holding the items relative to each other within the receiving cavity, each item holder being configured for holding at least one of the items, the item holders being stackable to form a plurality of item layers within the receiving cavity.

30 Claims, 7 Drawing Sheets

CYLINDRICAL CARDBOARD CONTAINER

CROSS-REFERENCE TO RELATED APPLICATION(S)

The present application claims priority from U.S. Provisional Patent Application No. 63/270,675, filed on Oct. 22, 2021, the entire specification of which is incorporated herein by reference.

TECHNICAL FIELD

The technical field generally relates to cardboard containers, and more specifically to cardboard containers that are cylindrical and are configured for the storage, transportation and/or shipping of items.

BACKGROUND

Boxes and other containers used for the storage, transportation and shipping of items may be made in a variety of configurations.

Unfortunately, existing containers suffer from a number of drawbacks. In some cases, the container may not be properly shaped or configured to hold the items received inside the container. This may be particularly important in cases where the items are relatively fragile, such as glass bottles or ceramic plates. In this case, movement of the items inside the container relative to each other or relative to the sides of the contains may damage the items during transport.

Existing containers may also include materials such as plastics or the like that are difficult or impossible to recycle or compost, which will lead to unnecessary waste and pollution when discarded.

In some cases, standard rectangular cardboard boxes may used to store and transport the items. However, when the container is used to store and transport luxury items such as wine bottles or the like, a standard rectangular cardboard box may not be able to provide the aesthetics that could be expected from a container holding such luxury items.

SUMMARY

According to one aspect, there is provided a cylindrical cardboard container comprising: a circular bottom wall having an outer bottom wall edge; a cylindrical sidewall extending upwardly from the bottom wall edge, the circular bottom wall and the cylindrical sidewall delimiting a receiving cavity sized and shaped to receive a plurality of items; a plurality of item holders for holding the items relative to each other within the receiving cavity, each item holder being configured for holding at least one of the items, the item holders being stackable to form a plurality of item layers within the receiving cavity.

In at least one embodiment, each item holder includes an item receptacle configured for receiving and holding at least one of the plurality of items.

In at least one embodiment, each item receptacle comprises an upper planar portion and at least one receiving recess extending downwardly from the upper planar portion.

In at least one embodiment, the at least one item receiving recess includes a plurality of item receiving recesses.

In at least one embodiment, the plurality of item receiving recesses includes three item receiving recesses disposed side-by-side with each other.

In at least one embodiment, each item receptacle includes a receptacle cavity and a plurality of separators extending in the receptacle cavity to divide the receptacle cavity into the plurality of item receiving recesses.

In at least one embodiment, each item receiving recess is sized and shaped to receive a bottle.

In at least one embodiment, each item receiving recess is sized and shaped to snuggly receive a standard 750 ml wine bottle.

In at least one embodiment, each item receiving recess has a recess width of between about 50 mm and 100 mm.

In at least one embodiment, the recess width is between about 65 mm and 95 mm.

In at least one embodiment, each item receiving recess has a recess length of between about 200 mm and 400 mm.

In at least one embodiment, the recess length is between about 250 mm and 350 mm.

In at least one embodiment, the cylindrical sidewall has a sidewall height corresponding to a multiple of a receptacle height of the item receptacle to allow the item receptacles to be stacked so as to substantially fill the receiving cavity.

In at least one embodiment, the receiving cavity is sized and shaped to receive from two to four item receptacles stacked over each other and filling the receiving cavity.

In at least one embodiment, the cylindrical sidewall is sized and shaped to receive two item receptacles stacked over each other and filling the receiving cavity.

In at least one embodiment, the cylindrical sidewall is sized and shaped to receive three item receptacles stacked over each other and filling the receiving cavity.

In at least one embodiment, the cylindrical sidewall is sized and shaped to receive four item receptacles stacked over each other and filling the receiving cavity.

In at least one embodiment, each item holder includes a protective mat disposable between two of the plurality of items stacked vertically to separate the two of the plurality of items from each other.

In at least one embodiment, the protective mat is substantially resilient.

In at least one embodiment, the protective mat is made from cardboard.

In at least one embodiment, the protective mat is substantially circular.

In at least one embodiment, the item holder extends across an entire transversal area of the receiving cavity to prevent lateral movement of the item holder received in the receiving cavity.

In at least one embodiment, the container further comprises a circular lid for selectively closing off the receiving cavity.

In at least one embodiment, the circular lid has a diameter that is slightly greater than a diameter of the cylindrical sidewall.

In at least one embodiment, the circular lid includes a top panel and a peripheral flange extending away from the top wall.

In at least one embodiment, the peripheral flange is at least slightly resilient.

In at least one embodiment, the circular lid further includes a closure mechanism selectively configurable in an open position in which the lid is removable from the cylindrical sidewall and a closed position in which the lid is prevented from moving relative to the cylindrical sidewall to thereby maintain the container closed.

In at least one embodiment, the closure mechanism includes a locking strap member extending around the peripheral flange and a latch member operatively connected to the locking strap member to allow the locking strap member to be selectively tightened around the peripheral flange.

In at least one embodiment, the locking strap member is made of metal.

In at least one embodiment, the container further comprises a pair of handles disposed at a diametrically opposite locations on the cylindrical sidewall.

In at least one embodiment, each handle includes a strap member having first and second strap ends secured to the cylindrical sidewall, proximal to each other, to form a loop.

In at least one embodiment, the container further includes a bottom edge overlapping member extending over at least a portion of the outer bottom wall edge and overlapping both the cylindrical sidewall and the circular bottom wall.

In at least one embodiment, the bottom edge overlapping member includes an annular angle member having a substantially L-shaped cross-section.

In at least one embodiment, the annular angle member extends substantially continuously along an entirety of the outer bottom wall edge.

According to another aspect, there is also provide a cylindrical cardboard container comprising: a circular bottom wall having an outer bottom wall edge; a cylindrical sidewall extending upwardly from the bottom wall edge, the circular bottom wall and the cylindrical sidewall delimiting a receiving cavity sized and shaped to receive a plurality of items; a plurality of item receptacles, each item receptacle including at least one item receiving recess sized and shaped for snuggly receiving and holding at least one of the plurality of items, the item receptacles being stackable to form a plurality of item layers within the receiving cavity.

DETAILED DESCRIPTION

Figure 1:
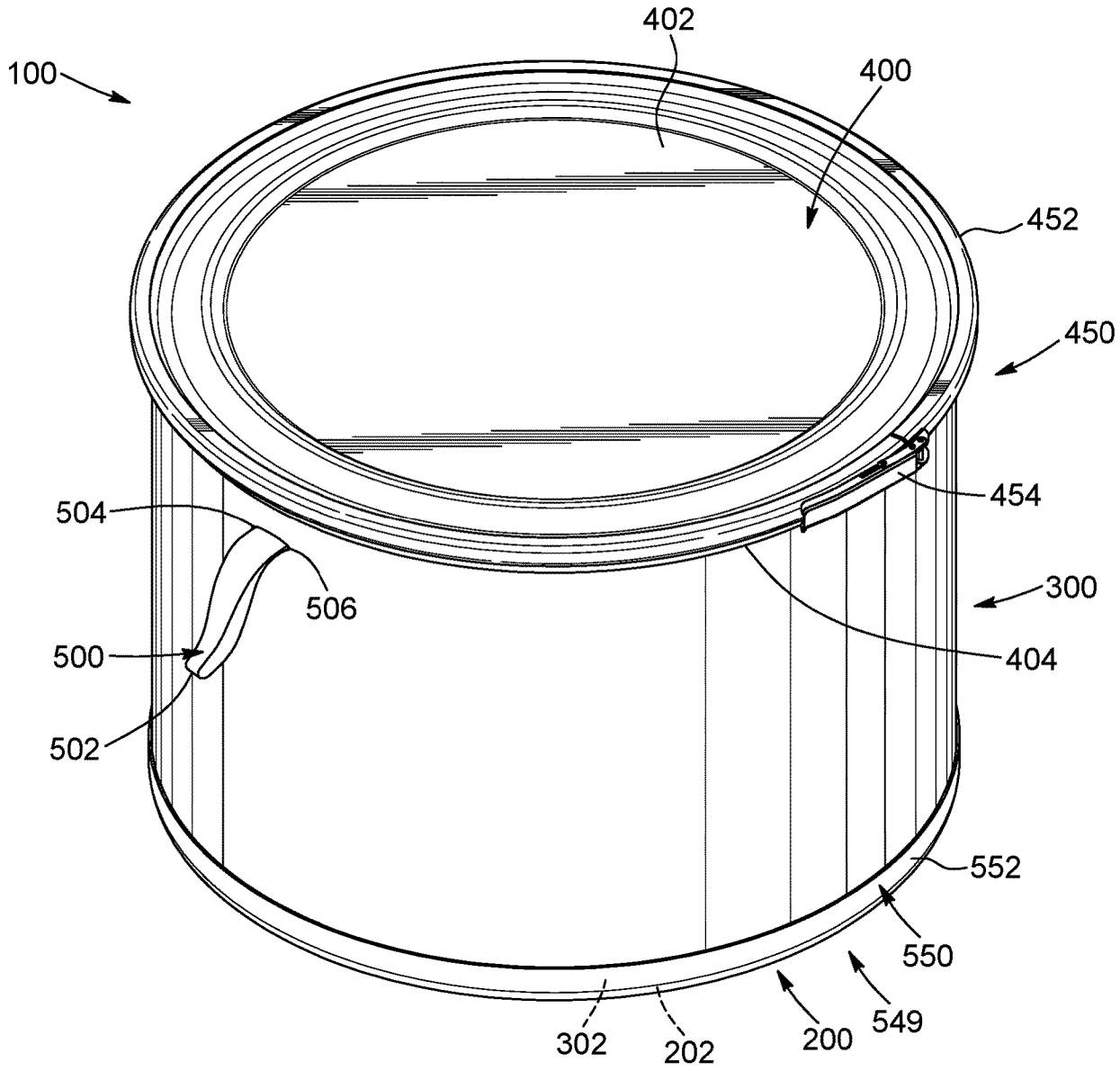
FIG. 1 is a top perspective view of a cylindrical cardboard container, in accordance with one embodiment.
Figure 2:
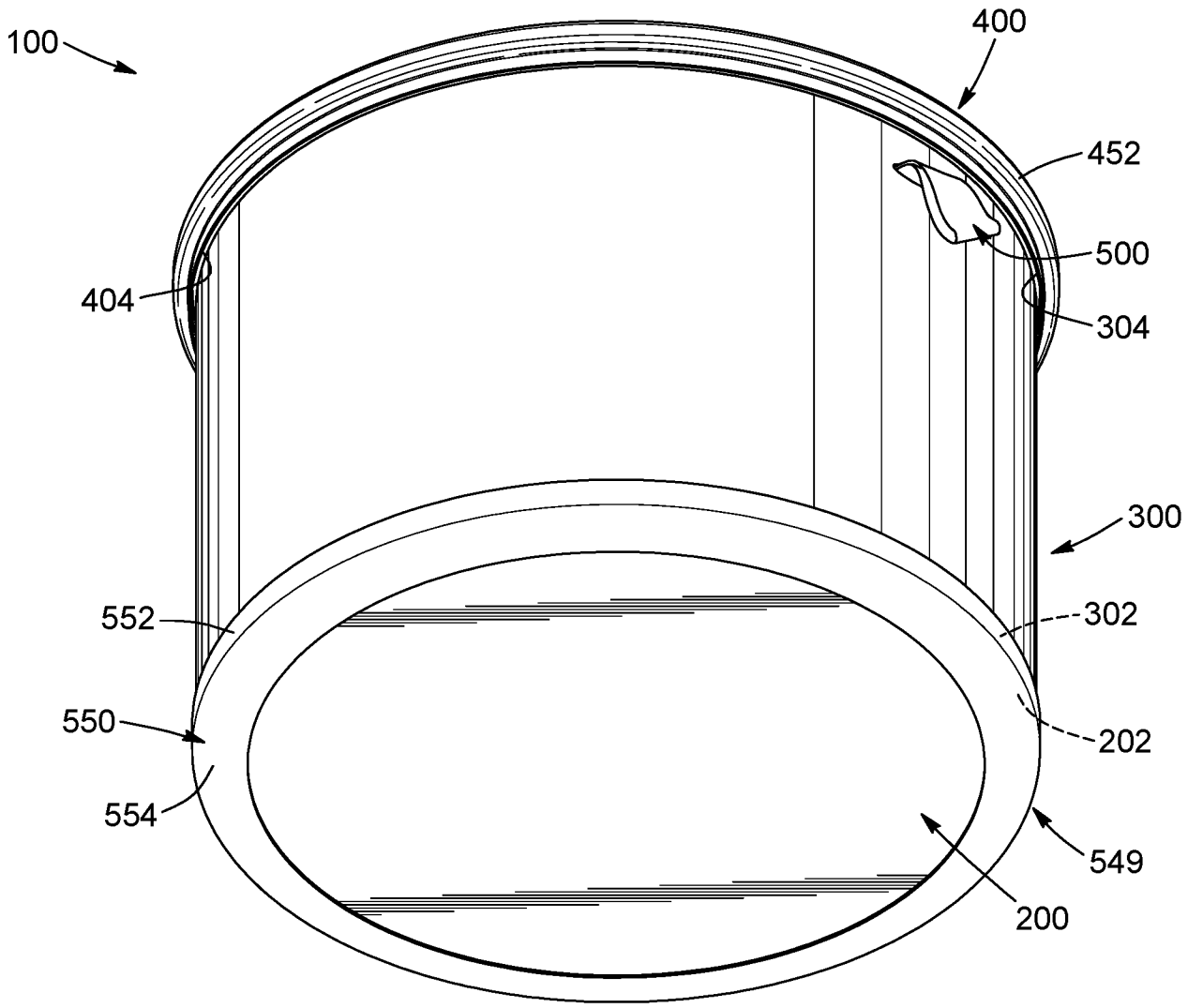
FIG. 2 is a bottom perspective view of the cylindrical cardboard container illustrated in FIG. 1.
Figure 3:
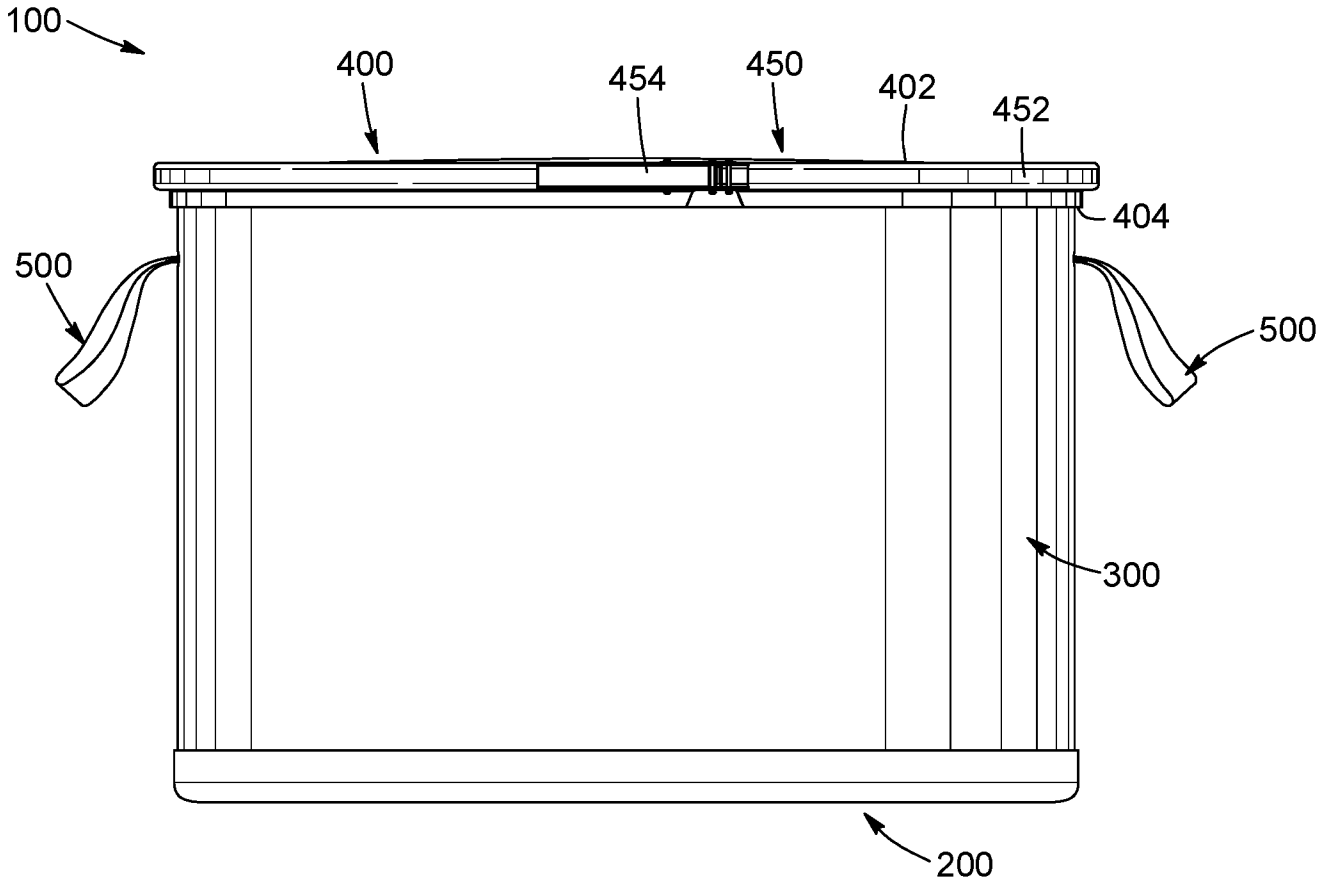
FIG. 3 is a side elevation view of the cylindrical cardboard container illustrated in FIG. 1.

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

For the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Moreover, it will be appreciated that positional descriptions such as "above", "below", "top", "bottom", "forward", "rearward" "left", "right" and the like should, unless otherwise indicated, be taken in the context of the figures and correspond to the position and orientation in the cylindrical cardboard container and corresponding parts when being used. Positional descriptions should not be considered limiting.

Referring now to FIGS. 1 to 7, there is shown a cylindrical cardboard container 100, in accordance with one embodiment. The container 100 may be used for the storage and/or transportation of a plurality of items. More specifically, the container 100 is configured to hold the items so as to prevent the items from moving relative to each other inside the container 100, as will be further explained below. The container 100 is therefore particularly well adapted for the storage and/or transport of relatively fragile items such as glass bottles, ceramic plates or the like.

The container 100 includes a circular bottom wall 200 and a cylindrical sidewall 300 extending upwardly from the bottom wall 200. Specifically, the bottom wall 200 has a circular outer bottom wall edge 202, and the cylindrical sidewall 300 has a lower sidewall end 302 connected to the circular outer bottom wall edge 202 and an upper sidewall end 304 opposite the lower sidewall end 302. The bottom wall 200 and the sidewall 300 delimit a receiving cavity 350, shown in FIG. 6, sized and shaped to receive the plurality of items.

In some embodiments, the cylindrical sidewall 300 could have a diameter of between about 300 mm and 500 mm. For example, in one embodiment, the cylindrical sidewall 300 could have a diameter of about 357 mm. In another embodiment, the cylindrical sidewall 300 could have a diameter of about 375 mm. In yet another embodiment, the container 100 could have a diameter of about 420 mm. Alternatively, the cylindrical sidewall 300 may have any other suitable diameter, which could be selected based on the number, size, shape and/or configuration of items to be received in the container 100 or based on any other relevant factor.

In the illustrated embodiment, the container 100 further includes a lid 400 for selectively closing off the container 100. Specifically, the lid 400 includes a top panel 402 and a peripheral flange 404 extending away from the top panel 402. The top panel 402 is substantially circular and has a diameter which is slightly greater than the diameter of the cylindrical sidewall 300 such that when the lid 400 is placed on the cylindrical sidewall 300 to close off the container 100, the upper sidewall end 304 of the cylindrical sidewall 300 abuts the top panel 402 and the peripheral flange 404 extends concentrically around the cylindrical sidewall 300. Alternatively, the upper sidewall end 304 of the cylindrical sidewall 300 may not abut the top panel 402 and may instead be spaced from the top panel 402. In this embodiment, the upper sidewall end 304 could instead be abuttable with one or more protruding element extending inwardly and substantially radially from an inner face of the peripheral flange 404, or the peripheral flange 404 could abut one or more protruding element extending outwardly and substantially radially from an outer face of the cylindrical sidewall 300, proximal to the upper sidewall end 304.

In the illustrated embodiment, the peripheral flange 404 is further at least slightly resilient such that a certain amount of pressure applied on the peripheral flange 404 in a substantially radial direction towards the cylindrical sidewall 300 causes the peripheral flange 404 to abut the sidewall 300, as will be further discussed below. Alternatively, instead of the peripheral flange 404 being resilient, the cylindrical sidewall 300 could be resilient, or both the peripheral flange 404 and the cylindrical sidewall 300 could be resilient. In yet another embodiment, the peripheral flange 404 and the cylindrical sidewall 300 may not be resilient and the peripheral flange 404 may instead be sized and shaped for a substantially precise fit with the cylindrical sidewall 300.

In the illustrated embodiment, the lid 400 further includes a closure mechanism 450 which is selectively configurable in an open position in which the lid 400 is removable from the cylindrical sidewall 300 and a closed position in which the lid 400 is prevented from moving relative to the cylindrical sidewall 300 to thereby maintain the container 100 closed.

In the illustrated embodiment, the closure mechanism 450 includes a locking strap member 452 extending around the peripheral flange 404 and a latch member 454 operatively connected to the locking strap member 452. The latch member 454 is configured to be manually activated by the user to selectively tighten the locking strap member 452 around the peripheral flange 404. As explained above, in this embodiment, the peripheral flange 404 is at least slightly resilient such that tightening the locking strap member 452 will cause the peripheral flange 400 to abut the cylindrical sidewall 300. More specifically, the latch member 454 is configured to tighten the locking strap member 452 with a predetermined force which creates sufficient friction between the peripheral flange 404 and the cylindrical sidewall 300 to prevent removal of the lid 400 from the cylindrical sidewall 300.

Figure 4:
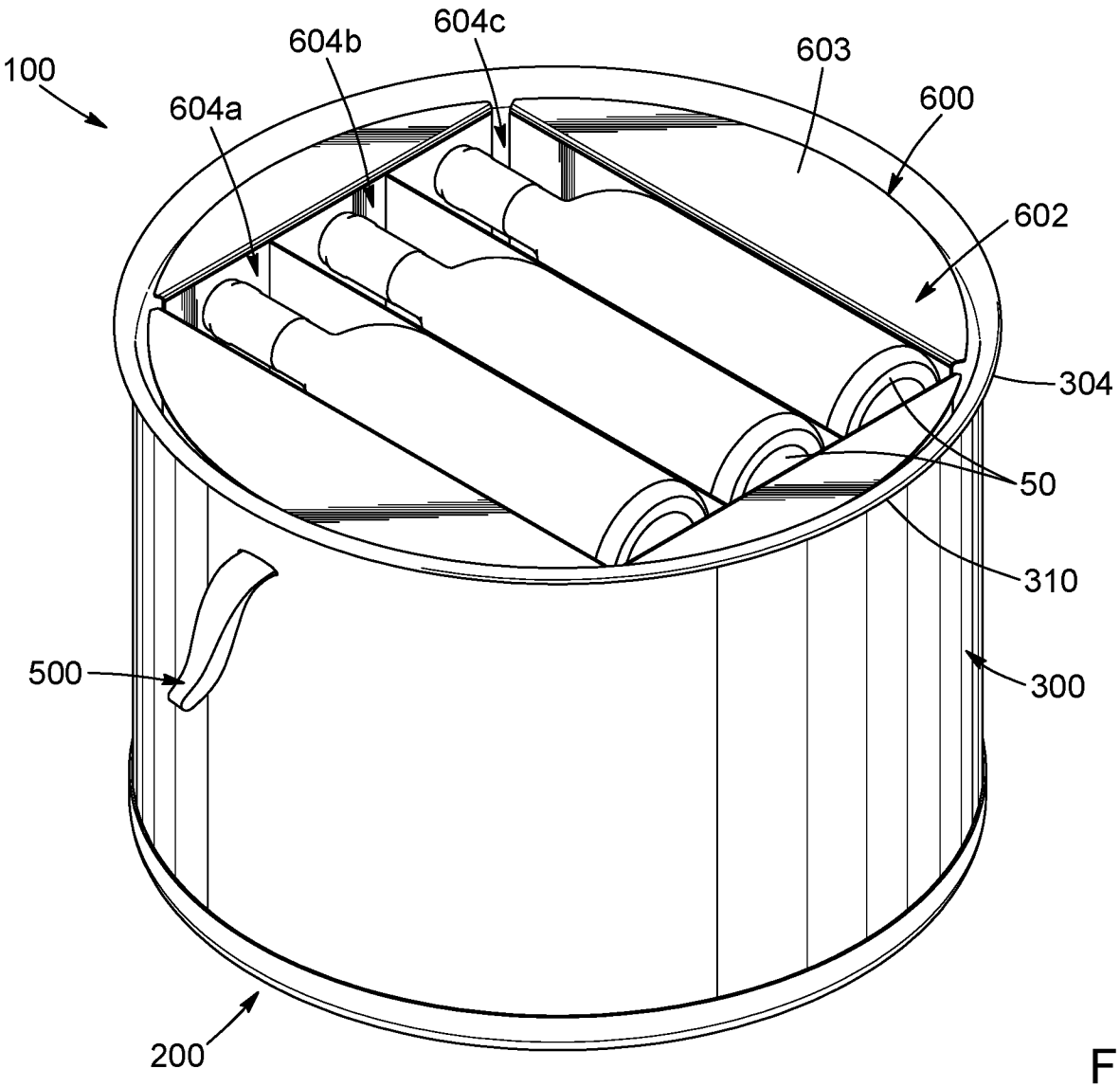
FIG. 4 is a top perspective view of the cylindrical cardboard container illustrated in FIG. 1, the lid removed.
Figure 6:
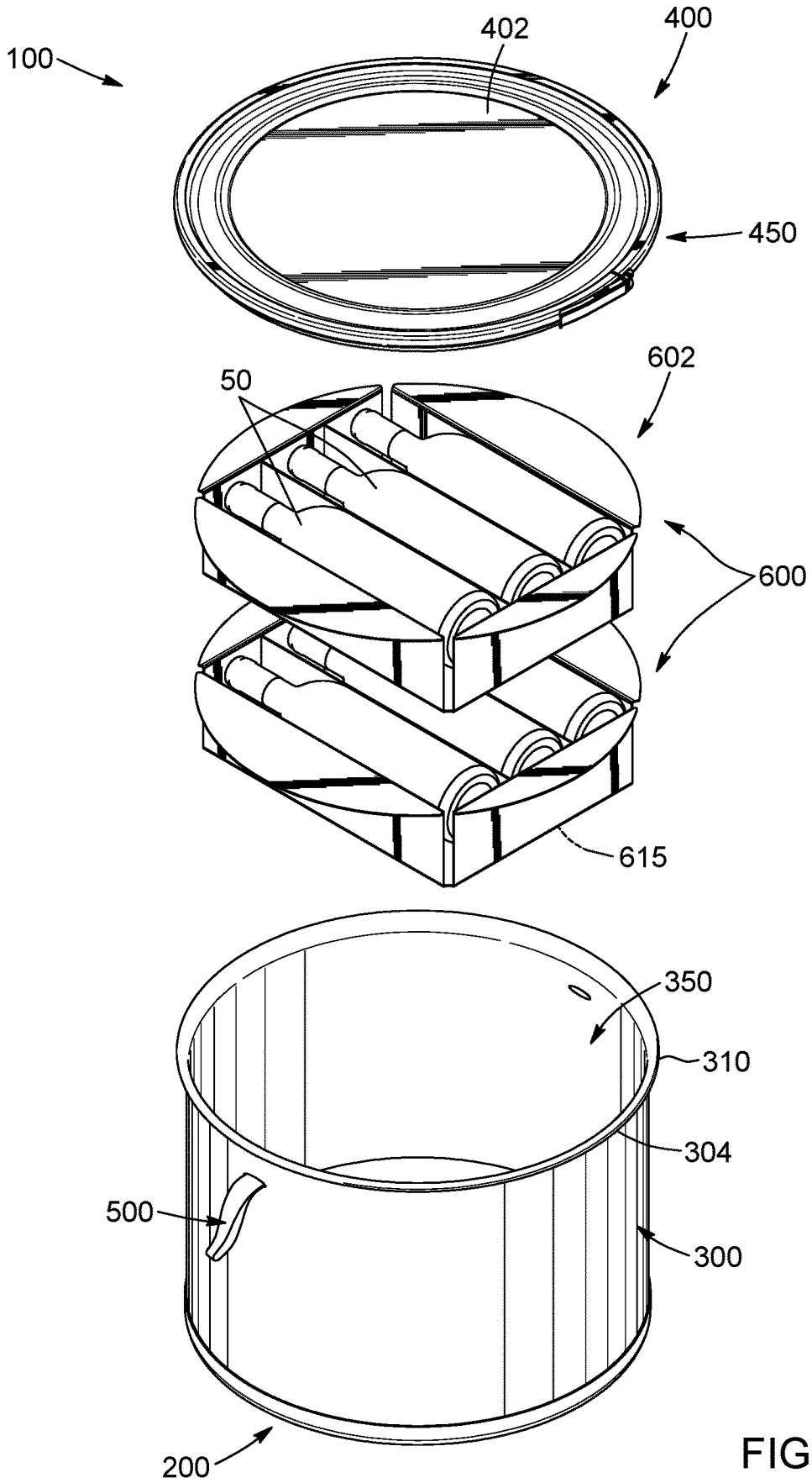
FIG. 6 is an exploded view of the cylindrical cardboard container illustrated in FIG. 1.

In the illustrated embodiment, the cylindrical sidewall 300 further includes an upper lip 310, shown in FIGS. 4 and 6, which extends radially outwardly from the cylindrical sidewall 300 at the upper sidewall end 304 thereof. The locking strap member 452 is further positioned on the peripheral flange 404 so as to be substantially aligned with the upper lip 310 when the lid 400 is received on the cylindrical sidewall 300. In this configuration, when the locking strap member 452 is tightened, in addition to the friction created by the peripheral flange 404 on the cylindrical sidewall 300, the upper lip 310 would create interference with the peripheral flange 404 to further prevent the lid 400 from being moved upwardly and away from the cylindrical sidewall 300. Alternatively, the cylindrical sidewall 300 may not comprise an upper lip 310 and the closure mechanism 450 may rely only on the friction between the peripheral flange 404 and the cylindrical sidewall 300 to maintain the lid 400 on the cylindrical sidewall 300 when in closed position.

The locking strap member 452 may be made of metal such as aluminum, steel or the like. Alternatively, the locking strap member 452 could be made of fabric, rubber, plastic, paper product, or any other material which would allow the locking strap member 452 to be substantially flexible so as to be positionable in a loop configuration around the peripheral flange 404 and be tightenable therearound.

In one embodiment, the latch member 454 could include a draw latch configured to create tension in the locking strap member 452 when closed and release tension from the locking strap member 452 when open, or could include any other suitable type of latch member. In some embodiments, the closure mechanism 450 may not include a locking strap member 452 and a latch member 454 and could instead include any suitable type of closure mechanism movable between a first position in which the lid 400 is substantially retained on the cylindrical sidewall 300 and a second position in which the lid 400 is substantially free from the cylindrical sidewall 300 and can be removed by a user. In yet another embodiment, the lid 400 may not include any closure mechanism.

The container 100 may further include a pair of handles 500 for facilitating the manipulation of the container 100. In the illustrated embodiment, the handles 500 are located on the cylindrical sidewall 300 and are disposed diametrically opposite each other. Still in the illustrated embodiment, each handle 500 includes a strap member 502 having first and second strap ends 504, 506 secured to the cylindrical sidewall 300, proximal to each other, to form a loop through which the user may insert his fingers or part of his hand. The strap member 502 could be made of a flexible material such as fabric, a plastic, cardboard or any other suitable substantially flexible material. Alternatively, the handles 500 could be made of a substantially rigid material and could be fixedly secured to the cylindrical sidewall 300 so as to prevent movement of the handles 500 relative to the cylindrical sidewall 300, or could be hingeably connected to the cylindrical sidewall 300 to allow at least some movement of the handles 500 relative to the cylindrical sidewall 300. In yet another embodiment, the handles 500 could instead include openings in the cylindrical sidewall 300 which are each sized and shaped to receive fingers or part of a user's hand, or have any other configuration suitable for the manipulation of the container 100.

In the illustrated embodiment, the container 100 further includes a bottom edge overlapping member 549 extending over at least a portion of the bottom wall edge 202 and overlapping both the cylindrical sidewall 300 and the bottom wall 200 proximal to the bottom wall edge 202. Specifically, in the illustrated embodiment, the bottom edge overlapping member 549 includes an annular angle member 550 extending over the outer bottom wall edge 202 and overlapping both the bottom wall 200 and the cylindrical sidewall 300. Specifically, the annular angle member 550 has a substantially L-shaped cross-section and includes an upper portion 552 extending along the cylindrical sidewall 300 and a lower portion 554 extending along the bottom wall 200. In one embodiment, the annular angle member 550 is provided for connecting the bottom wall 200 to the cylindrical sidewall 300. More specifically, in this embodiment, the cylindrical sidewall 300 is made from a first piece of sheet material which has been adequately curved and the bottom wall 200 is made from a second piece of sheet material which has been cut or otherwise formed into the circular bottom wall 200. In this embodiment, the cylindrical sidewall 300 may be secured to the upper portion 552 of the annular angle member 550 and the bottom wall 200 may be secured to the lower portion 554 of the annular angle member 550, using an appropriate securing technique such as gluing or the like. Alternatively, the bottom wall 200 and the cylindrical sidewall 300 may be directly secured to each other or be secured using other means that do not involve the annular angle member 550. In this embodiment, the annular angle member 550 may merely serve to protect the interface between the bottom wall 200 and the cylindrical sidewall 300 and to reinforce this portion of the container 100.

In one embodiment, the annular angle member 550 may further act as a base such that when the container 100 is placed on a receiving surface, the annular angle member 550 rests on the receiving surface instead of the bottom wall 200. In this embodiment, the annular angle member 550, which has a certain thickness, will cause the bottom wall 200 to be slightly spaced away from the receiving surface, thereby protecting the bottom wall 200 from potential damage from contacting the receiving surface. It will be further understood that this feature may be particularly useful when the container 100 is stacked with other similar containers. In this case, the annular angle member 550 of each container 100 rest on a rim portion of the lid 400 of the container immediately below. The full weight of the containers will therefore be supported by the annular angle members 550 and transmitted vertically through the cylindrical sidewall 300, rather than being supported by the central portion of the bottom wall 200 and the lid 400. This may therefore help prevent damage to the stacked containers.

In the illustrated embodiment, the annular angle member 550 extends substantially continuously along the entire bottom wall edge 202. Alternatively, the bottom edge overlapping member 549 could include a plurality of angle member segments that would be spaced from each other along the bottom wall edge 202. In one embodiment, the annular angle member 550 is made from a paper product such as cardboard. In some embodiments, the annular angle member 550 may be configured to be substantially more rigid than the bottom wall 200 and the cylindrical sidewall 300. Specifically, the annular angle member 550 may be made from the same cardboard as the bottom wall 200 and the cylindrical sidewall 300 but may be folded so as to be substantially thicker than the bottom wall 200 and the cylindrical sidewall 300. In another embodiment, the annular angle member 550 may be made from a thicker cardboard or from a heavier cardboard than the bottom wall 200 and the cylindrical sidewall 300. In yet another embodiment, the annular angle member 550 could instead be made from metal, a plastic, or any other suitable material.

Figure 5:
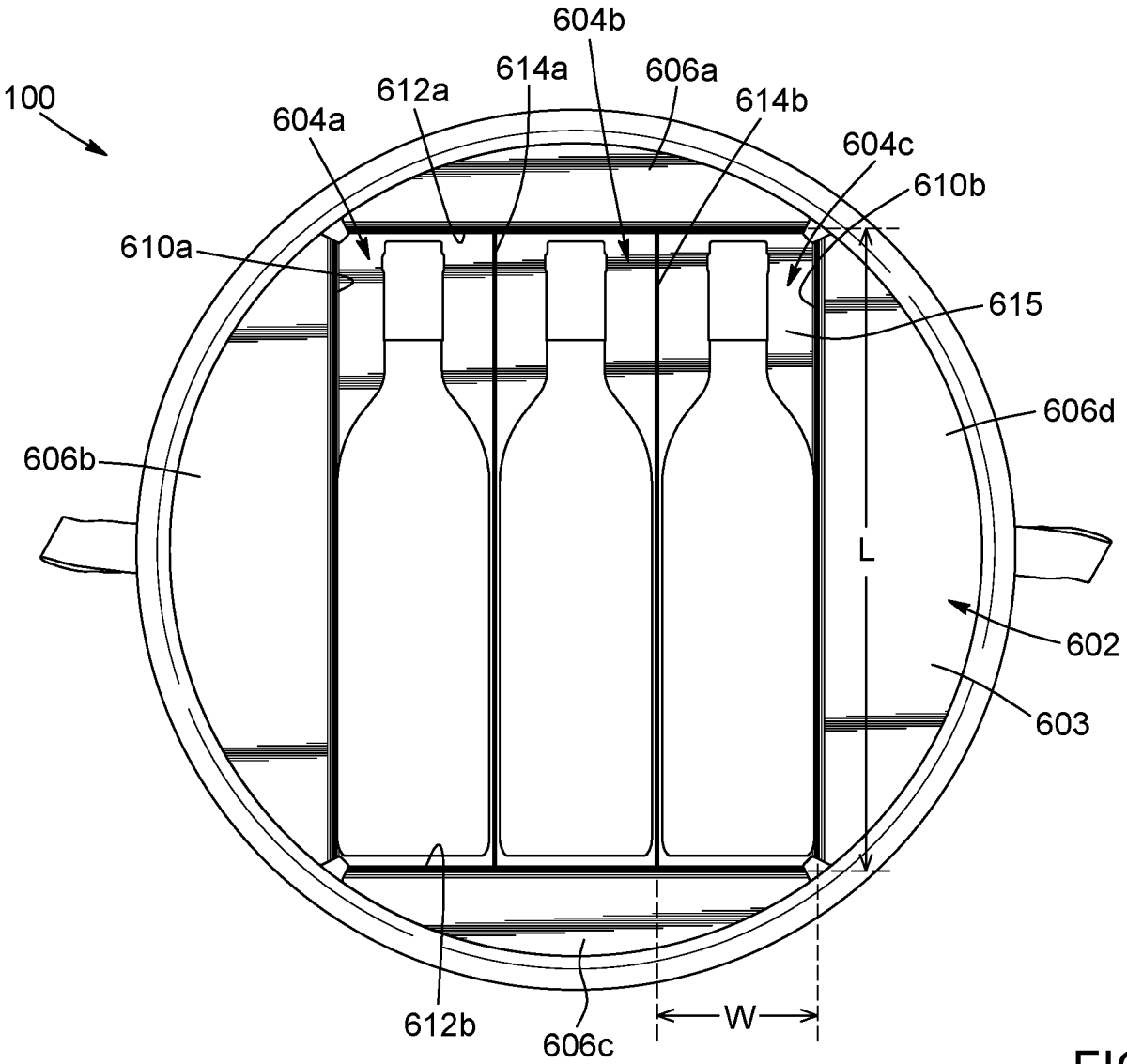
FIG. 5 is a top plan view of the cylindrical cardboard container with the lid removed as illustrated in FIG. 4.

Turning now to FIGS. 4 to 6, the container 100 further includes a plurality of item holders 600 which are configured for holding the items relative to each other inside the receiving cavity 350. In the illustrated embodiment, the items are bottles, and more specifically wine bottles 50, and each item holder 600 is an item receptacle 602 which is configured for receiving at least one item.

It will be understood that the term "wine bottle" used herein refers to items having the general shape and configuration of a wine bottle but is not limited to bottles containing wine. For example, the bottles could instead contain champagne or any other alcoholic or non-alcoholic beverage. In other embodiments, instead of bottles, the items could include any other item which would be suitable for transportation and storage in the container 100.

In the illustrated embodiment, the item receptacle 602 includes an upper planar portion 603 and first, second and third item receiving recesses 604*a*, 604*b*, 604*c* which extend downwardly from the upper planar portion 603. Each item receiving recess 604*a*, 604*b*, 604*c* is substantially rectangular and elongated, and extends along a longitudinal axis A. The item receiving recess 604*a*, 604*b*, 604*c* are disposed side-by-side, adjacent each other, such that the longitudinal axes A of all three receiving recesses 604*a*, 604*b*, 604*c* extend substantially parallel to each other.

In the illustrated embodiment, each item receiving recess 604*a*, 604*b*, 604*c* is sized and shaped to snuggly receive one of the items, i.e. one of the wine bottles 50 in the present embodiment. This prevents the wine bottle 50 from moving within the item receiving recess 604*a*, 604*b*, 604*c*. In the illustrated embodiment, the item receiving recess 604*a*, 604*b*, 604*c* is sized and shaped to receive a standard 750 ml wine bottle. In this embodiment, the item receiving recess 604*a*, 604*b*, 604*c* therefore has a recess width W corresponding to a width of a standard 750 ml wine bottle and a recess length L corresponding to a length of a standard 750 ml wine bottle. Specifically, each item receiving recess 604*a*, 604*b*, 604*c* may have a recess width W of between about 50 mm and 100 mm, and more specifically of between about 65 mm and 95 mm. In one embodiment, each item receiving recess 604*a*, 604*b*, 604*c* may have a recess length L of between about 200 mm and 400 mm, and more specifically of between about 250 mm and 350 mm.

In the illustrated embodiment, the item receiving recess 604*a*, 604*b*, 604*c* further has a depth corresponding to a depth of a standard 750 ml wine bottle (which corresponds to the width of the standard 750 ml wine bottle since the standard 750 ml wine bottle is substantially cylindrical). Therefore, the item receiving recess 604*a*, 604*b*, 604*c* may have a depth of between about 50 mm and 100 mm, and more specifically of between about 65 mm and 95 mm. In one embodiment, the item receiving recess 604*a*, 604*b*, 604*c* could have a depth which is less than the depth of a standard 750 ml wine bottle. In this embodiment, the wine bottle 50 would extend slightly above the upper planar portion 603 when received in the item receiving recess 604*a*, 604*b*, 604*c*.

Alternatively, the item receiving recesses 604*a*, 604*b*, 604*c* could be sized and shaped differently to receive bottles having other formats (e.g. standard 1.5 L wine bottles) or any other item that is to be stored and/or transported in the container 100.

In some embodiments, the item receiving recesses 604*a*, 604*b*, 604*c* may not be sized and shaped to snuggly receive one of the items, but could instead be substantially larger than the item to accommodate packaging or padding material around the item to protect the item when received in the corresponding recess.

Still in the illustrated embodiment, the upper planar portion 603 is sized and shaped to be received snuggly in the receiving cavity 350. Specifically, the upper planar portion 603 has a diameter which is substantially equal to the diameter of the receiving cavity 350. Therefore, the item receptacle 602 is prevented from moving laterally within the receiving cavity 350.

In one embodiment, the item receptacle 602 may be formed using a blank of sheet material which is suitably cut and folded so as to form four planar pieces 606*a*, 606*b*, 606*c*, 606*d* shaped as circular segments, together defining the upper planar portion 603, and a single, rectangular receptacle cavity 608 extending between the four planar pieces 606*a*. The receptacle cavity 608 is delimited laterally by first and second side walls 610*a*, 610*b* and a pair of end walls 612*a*, 612*b* extending perpendicularly to the side walls 610*a*, 610*b*. In this embodiment, the item receptacle 602 further includes first and second vertical separators 614*a*, 614*b* which extend into the receptacle cavity 608 between the end walls 612*a*, 612*b* and substantially parallel to the side walls 610*a*, 610*b*. The vertical separators 614*a*, 614*b* are spaced from each other and from the side walls 610*a*, 610*b* to define the item receiving recesses 604*a*, 604*b*, 604*c* therebetween. More specifically, the first vertical separator 614*a* is spaced from the first side wall 610*a* to form the first item receiving recess 604*a*, the first and second vertical separators 614*a*, 614*b* are spaced from each other to form the second item receiving recess 604*b* and the second vertical separator 614*b* is spaced from the second side wall 610*b* to form the third item receiving recess 604*c*.

In this embodiment, the width W of each item receiving recess 604*a*, 604*b*, 604*c* is defined by a distance between the first side wall 610*a* and the first vertical separator 614*a* and/or by a distance between the first and second vertical separators 614*a*, 614*b* and/or by a distance between the second vertical separator 614*b* and the second side wall 610*b*. Still in this embodiment, the length L of the item receiving recesses 604*a*, 604*b*, 604*c* is defined by a distance between the end walls 612*a*, 612*b*.

In the illustrated embodiment, the vertical separators 614*a*, 614*b* are substantially evenly spaced from each other and from the side walls 610*a*, 610*b* such that the all the item receiving recesses 604*a*, 604*b*, 604*c* have a same width W. Alternatively, the vertical separators 614*a*, 614*b* could be spaced from each other and/or from the side walls 610*a*, 610*b* by different distances such that the such that item receiving recesses 604*a*, 604*b*, 604*c* have different widths.

In the illustrated embodiment, the vertical separators 614*a*, 614*b* are separate from the rest of the item receptacle 602. Specifically, the vertical separators 614*a*, 614*b* are formed from one or more additional blank sheets of material and are received in the receptacle cavity 608 once the receptacle cavity 608 has been formed in the blank sheet of material. In one embodiment, each separator 614*a*, 614*b* may be folded towards its ends to define one or more end flanges which could be secured to the end walls 612*a*, 612*b* or at least extend against the end walls 612*a*, 612*b* to facilitate the positioning of the separator 614*a*, 614*b*. In another embodiment, instead of being separate from the rest of the item receptacle 602, the vertical separators 614*a*, 614*b* could be formed in the same blank sheet of material used to form the receptacle cavity 608.

In yet another embodiment, instead of including two vertical separators 614*a*, 614*b* defining three item receiving recesses 604*a*, 604*b*, 604*c*, the item receptacle 602 could include more or less than two vertical separators 614*a*, 614*b* defining more or less than three item receiving recesses 604*a*, 604*b*, 604*c*. For example, the item receptacle 602 could include one or two item receiving recesses, or could include more than three item receiving recesses.

In still another embodiment, the item receptacle 602 could further include one or more transversal separators extending transversally to the vertical separators 614*a*, 614*b* and substantially parallel to the end walls 612*a*, 612*b* to divide each item receiving recess 604*a*, 604*b*, 604*c* into one or more sub-recesses which can be sized and shaped according to items to be received therein. The transversal separators could extend along an entire width of the receptacle cavity 608 between the side walls 610*a*, 610*b* or each item receiving recess 604*a*, 604*b*, 604*c* could include transversal separators that are distinct from the transversal separators extending in the other item receiving recess 604*a*, 604*b*, 604*c*.

The receptacle cavity 608 is further delimited by a bottom panel 615 which supports the bottles 50 received in the item receiving recesses 604*a*, 604*b*, 604*c*. In the illustrated embodiment, the bottom panel 615 is substantially rectangular and extends between the side walls 610*a*, 610*b* and the end walls 612*a*, 612*b*. Still in the illustrated embodiment, the bottom panel 615 is further substantially planar and extends substantially parallel to the upper planar portion 603. Alternatively, the bottom panel 615 may not be planar and may instead be substantially concavely curved under each item receiving recess 604*a*, 604*b*, 604*c* to receive the bottles 50, or have any other suitable shape and configuration.

In another embodiment, the item receptacle 602 may not be formed from a folded blank of sheet material and could instead be made according to various alternative configurations. For example, the item receptacle 602 could include a solid receptacle body, made from foam or any other similar substance, and the item receiving recesses 604*a*, 604*b*, 604*c* could be defined into the receptacle body.

The item receptacles 602 are further stackable with each other, thereby forming multiple item layers within the receiving cavity 350. In the illustrated embodiment, the container 100 is further configured such that the item receptacles 602 substantially fill the receiving cavity 350, i.e. such that the upper planar portion 603 of the uppermost item receptacle 602 is substantially aligned with the upper sidewall end 304 of the cylindrical sidewall 300, as shown in FIG. 4. Specifically, the cylindrical sidewall 300 has a height which is a multiple of a height of the item receptacles 602. For example, the cylindrical sidewall 300 may be sized to receive two, three or four item receptacles 602 stacked over each other to thereby define respectively two, three and four item layers within the receiving cavity 350. In another embodiment, the cylindrical sidewall 300 could instead be sized to receive a single item receptacle 602, or more than four item receptacles 602.

In the illustrated embodiment, all the item receptacles 602 include a same number of item receiving recesses. More specifically, in the illustrated embodiment, all the item receptacles 602 include three item receiving recesses. Alternatively, at least two of the item receptacles 602 could have a different number of item receiving recesses. For example, one of the item receptacles 602 could have three item receiving recesses while another one of the item receptacles 602 could have one or two item receptacles 602. Still in the illustrated embodiment, the item receiving recesses of all the item receptacles 602 are substantially similarly shaped, sized and positioned but alternatively, the item receptacles 602 of one of the item receptacles 602 could be shaped, sized and/or positioned differently than the item receptacles 602 of another one of the item receptacles 602.

In one embodiment, at least the bottom wall 200 and the cylindrical sidewall 300 are made of cardboard such as corrugated cardboard, liner cardboard, medium cardboard, kraft cardboard, and any other similar paper product. The term "cardboard" as used herein is not limited to paper or paper products of a particular density or grammage, and includes flexible, thick, pliable, and other appropriate paper products, of any suitable density or grammage. In one embodiment, the top panel 402 and the peripheral flange 404 of the lid 400 could further be made of cardboard.

Figure 7:
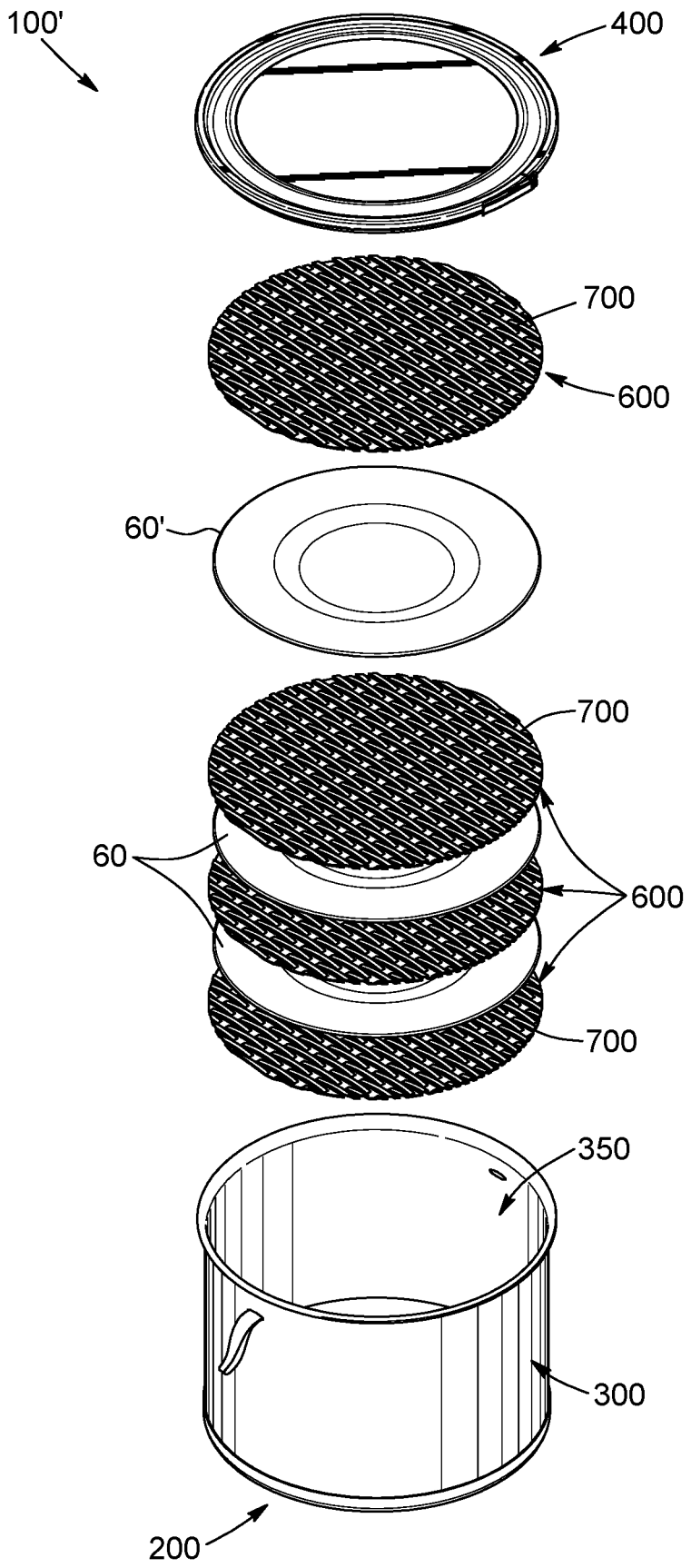
FIG. 7 is an exploded view of a cylindrical cardboard container, in accordance with another embodiment.

Referring now to FIG. 7, there is shown a cylindrical cardboard container 100', in accordance with another embodiment. Similarly to the container 100 described above, the container 100' includes the bottom wall 200 and the cylindrical sidewall 300 extending upwardly from the bottom wall 200 to define the receiving cavity 350, which can be selectively closed off with the lid 400.

The container 100' further includes a plurality of item holders 600 for holding the items relative to each other inside the receiving cavity 350. In this embodiment, the container 100' is adapted to store and transport dishes or plates 60 rather than bottles. As shown in FIG. 7, the container 100 is sized and shaped such that each plate 60 extend across an entire transverse area of the receiving cavity 350. Specifically, the cylindrical sidewall 300 has a diameter which is substantially similar to the diameter of the plates 60. This prevents lateral movement of the plates 60 within the receiving cavity 350.

In this embodiment, each item holder 600 includes a protective mat 700 which can be disposed between two of the plates 60 stacked vertically to separate the two plates 60 from each other. A protective mat 700 could further be placed on top of the uppermost plate 60' so as to be sandwiched between the uppermost plate 60' and the lid 400 when the lid 400 is closed.

The protective mat 700 further extends across an entire transverse area of the receiving cavity 350. Specifically, in the illustrated embodiment, the protective mat 700 is substantially circular and has a diameter which is substantially similar to the diameter of the cylindrical sidewall 300 and of the plates 60. This prevents the protective mat 700 from moving laterally and ensures that contact between the two adjacent plates is prevented across the entire area of the plates.

In one embodiment, the protective mat 700 is at least slightly resilient in a thicknesswise direction to cushion any movement of the plates 60 relative to each other or of the uppermost plate 60' with the lid 400. For example, each protective mat 700 could be made of cardboard which has been shaped to form a particular three-dimensional structure which provides resiliency to the protective mat 700. Specifically, the protective mat 700 may be made from new cardboard or used cardboard, and could be formed using a single, continuous cardboard sheet shaped appropriately using a dedicated mat manufacturing machine. Specifically, the protective mat 700 could include one or more perforations, and more specifically one or more elongated perforations or slits, which form strips of cardboard that are slightly curved to form a three-dimensional pattern.

In one embodiment, the protective mat 700 could be manufactured by creating the three-dimensional pattern in a rectangular cardboard sheet and then cutting the rectangular cardboard sheet in a circular shape to form the protective mat 700. Alternatively, the rectangular cardboard sheet could first be cut in a circular shape and then the three-dimensional pattern could be created in the circular piece of carboard.

In another embodiment, the protective mat 700 could instead simply be made of a piece of corrugated carboard which has a sufficient thickness to provide a desirable level of resiliency. In other embodiments, the protective mat 700 could still be made of cardboard but have any other suitable alternative configuration.

Alternatively, the protective mat 700 may be made of any other material including fabric such as felt or the like, rubber, foam, or any other suitable material. The protective mat could further include a single layer of material or include a plurality of layers of material stacked over each other and secured together to form the protective mat 700.

It will be appreciated that the above-described embodiments are provided as examples only and that various other configurations and combinations may be considered. For example, the container 100 illustrated in FIGS. 1 to 6 could further include one or more protective mats similar to the protective mat 700. The protective mats would be placed between the item receptacles 602 and/or between the uppermost item receptacle 602 and the lid 400 to further protect the bottles from movement in the vertical direction and from contact with bottles from other item layers.

It will also be understood that although the above-described embodiments concern containers for wine bottles and plates, any other items, regardless of whether the item is fragile or not, could be stored and/or transported using the present container.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

The invention claimed is:

1. A cylindrical cardboard container comprising:
- a circular bottom wall having an outer bottom wall edge;
- a cylindrical sidewall extending upwardly from the bottom wall edge, the circular bottom wall and the cylindrical sidewall delimiting a receiving cavity sized and shaped to receive a plurality of items, the receiving cavity having a receiving cavity diameter;
- a plurality of item holders for holding the items relative to each other within the receiving cavity, each item holder being configured for holding at least one of the items, the item holders being stackable to form a plurality of item layers within the receiving cavity;
- each item holder being made of at least one blank of sheet material which is foldable to form:
  - an upper planar portion, the upper planar portion having a planar portion diameter corresponding to the receiving cavity diameter; and
  - a rectangular item receptacle extending downwardly from the upper planar portion;
  - each item holder further comprising vertical separators housed within the rectangular item receptacle, the vertical separators dividing the rectangular item receptacle into two or more item receiving recesses.

2. The container as claimed in claim 1, wherein the plurality of item receiving recesses includes three item receiving recesses disposed side-by-side with each other.

3. The container as claimed in claim 1, wherein the vertical separators are foldable and adjustable.

4. The container as claimed in claim 1, wherein each item receiving recess is sized and shaped to receive a bottle.

5. The container as claimed in claim 4, wherein each item receiving recess is a substantially rectangular recess having a recess width, a recess depth and a recess length adapted to receive a 750 ml wine bottle.

6. The container as claimed in claim 5, wherein the recess width is between about 50 mm and 100 mm.

7. The container as claimed in claim 6, wherein the recess width is between about 65 mm and 95 mm.

8. The container as claimed in claim 6, wherein the recess length is between about 200 mm and 400 mm.

9. The container as claimed in claim 8, wherein the recess length is between about 250 mm and 350 mm.

10. The container as claimed in claim 2, wherein the receiving cavity is sized and shaped to receive between two and four item holders stacked over each other and filling the receiving cavity.

11. The container as claimed in claim 1, wherein each item holder includes a protective mat disposable between two of the plurality of items stacked vertically to separate the two of the plurality of items from each other.

12. The container as claimed in claim 11, wherein the protective mat is substantially resilient.

13. The container as claimed in claim 12, wherein the protective mat is made from cardboard.

14. The container as claimed in claim 13, wherein the protective mat is substantially circular.

15. The container as claimed in claim 1, wherein each item holder extends across an entire transversal area of the receiving cavity to prevent lateral movement of the item holder received in the receiving cavity.

16. The container as claimed in claim 1, further comprising a circular lid for selectively closing off the receiving cavity.

17. The container as claimed in claim 16, wherein the circular lid has a diameter that is slightly greater than a diameter of the cylindrical sidewall.

18. The container as claimed in claim 17, wherein the circular lid includes a top panel and a peripheral flange extending away from the top panel.

19. The container as claimed in claim 18, wherein the circular lid further includes a closure mechanism selectively configurable in an open position in which the lid is removable from the cylindrical sidewall and a closed position in which the lid is prevented from moving relative to the cylindrical sidewall to thereby maintain the container closed.

20. The container as claimed in claim 19, wherein the closure mechanism includes a locking strap member extending around the peripheral flange and a latch member operatively connected to the locking strap member to allow the locking strap member to be selectively tightened around the peripheral flange.

21. The container as claimed in claim 1, further comprising a pair of handles disposed at a diametrically opposite locations on the cylindrical sidewall.

22. The container as claimed in claim 1, further including a bottom edge overlapping member extending over at least a portion of the outer bottom wall edge and overlapping both the cylindrical sidewall and the circular bottom wall.

23. The container as claimed in claim 22, wherein the bottom edge overlapping member includes an annular angle member having a substantially L-shaped cross-section.

24. The container as claimed in claim 23, wherein the annular angle member extends substantially continuously along an entirety of the outer bottom wall edge.

25. The container as claimed in claim 1, wherein the blank of sheet material is cut and folded to form four planar pieces shaped as circular segments together defining the upper planar portion and a single rectangular item receptacle extending between the four planar pieces.

26. The container as claimed in claim 25, wherein the vertical separators are formed from one or more additional blank sheets of material.

27. The container as claimed in claim 3, wherein the vertical separators are spaced from each other or from side walls of the rectangular item receptacle by different distances, the two or more item receiving recesses having different widths.

28. The container as claimed in claim 8, wherein the recess depth is between 65 mm and 95 mm.

29. The container as claimed in claim 26, wherein:

the rectangular item receptacle of each of the item holders has a lower surface, for facing the circular bottom wall, the vertical separators comprise respective top edges, at least one of the item holders, when in the receiving cavity, has its lower surface resting on the top edges of the vertical separators of another one of the item holders placed underneath said one item holder.

30. A cylindrical cardboard container comprising:

a circular bottom wall having an outer bottom wall edge;

a cylindrical sidewall extending upwardly from the bottom wall edge, the circular bottom wall and the cylindrical sidewall delimiting a receiving cavity sized and shaped to receive a plurality of items, the receiving cavity having a cavity diameter;

a plurality of item receptacles, each item receptacle including at least one item receiving recess sized and shaped for snuggly receiving and holding at least one of the plurality of items, the item receptacles being stackable to form a plurality of item layers within the receiving cavity;

each item receptacle being made of at least one blank of sheet material which is foldable to form:

an upper planar portion, the upper planar portion having a planar portion diameter corresponding to the cavity diameter; and a rectangular item receptacle cavity extending downwardly from the upper planar portion;

each item receptacle further comprising one or more separators made of an additional blank of sheet material, housed within the rectangular item receptacle cavity, the additional blank of sheet being foldable and adjustable to divide the rectangular item receptacle cavity into two or more item receiving recesses.

* * * * *